US009824678B1

(12) United States Patent
Ou

(10) Patent No.: US 9,824,678 B1
(45) Date of Patent: Nov. 21, 2017

(54) METHOD, SYSTEM FOR SELF-TUNING ACTIVE NOISE CANCELLATION AND HEADSET APPARATUS

(71) Applicant: C-MEDIA ELECTRONICS INC., Taipei (TW)

(72) Inventor: Kuen-Ying Ou, Taichung (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 0 days.

(21) Appl. No.: 15/363,009

(22) Filed: Nov. 29, 2016

(30) Foreign Application Priority Data

Jul. 15, 2016 (TW) ..... 105122388 A

(51) Int. Cl.
*G10K 11/16* (2006.01)
*G10K 11/178* (2006.01)

(52) U.S. Cl.
CPC .. *G10K 11/1788* (2013.01); *G10K 2210/1081* (2013.01); *G10K 2210/3012* (2013.01); *G10K 2210/3023* (2013.01); *G10K 2210/3028* (2013.01)

(58) Field of Classification Search
CPC ..... G10K 11/1784; G10K 2210/108; G10K 11/178; G10K 2210/1081; G10K 2210/503; G10K 11/16; G10K 2210/3028; G10K 2210/3055; G10K 2210/3026; G10K 2210/3022; G10K 2210/3039; G10K 11/175; G10K 2210/316; H04R 3/002; H04R 2410/05; H04R 3/005; H04R 1/1083; H04R 29/006; H04R 1/028; H04R 1/08; H04R 1/406; H04R 2203/12; H04R 2410/01; H04R 2430/20; H04R 2499/11;
(Continued)

(56) References Cited

U.S. PATENT DOCUMENTS 8,515,089 B2 * 8/2013 Nicholson ..... G10K 11/1782 381/71.6
8,718,291 B2 * 5/2014 Alves ..... G10K 11/1784 381/71.11

(Continued)

FOREIGN PATENT DOCUMENTS

| | | | |
|---|---|---|---|
| CN | 102158778 | A | 8/2011 |
| GB | 2445984 | A | 7/2008 |
| TW | 200835379 | A | 8/2008 |

*Primary Examiner* — Lun-See Lao
(74) *Attorney, Agent, or Firm* — Li & Cai Intellectual Property (USA) Office

(57) ABSTRACT

The disclosure is related to a method and a system for self-tuning active noise canceller (STANC) and a headset apparatus. The headset apparatus is placed on a measurement device to emulate user scenario where the user receives audio signal from the headset. The STANC system receives environmental noise signal from a microphone inside the headset. The output of the STANC system acts as reverse noise signal to suppress the environmental noise signal via a speaker unit. The corresponding mixture signal is defined as an error signal. In a calibration mode, the error signal received from the measurement device can be used to update the STANC parameters. The process will be done when the error signal is lower than a predefined threshold. The final parameters can be saved as default settings for the headset apparatus in a user mode.

14 Claims, 6 Drawing Sheets

(58) Field of Classification Search
CPC ... H04R 29/005; H04R 2460/01; H04R 5/033
USPC ..... 381/71.1–71.6, 94.1–94.4, 72, 74, 381/71.11–71.14, 74.7; 700/94
See application file for complete search history.

(56) References Cited

U.S. PATENT DOCUMENTS

| | | | | |
|---|---|---|---|---|
| 2011/0293103 | A1* | 12/2011 | Park | G10K 11/1782 381/57 |
| 2014/0044275 | A1 | 2/2014 | Goldstein et al. | |
| 2014/0169579 | A1* | 6/2014 | Azmi | G10K 11/16 381/71.6 |
| 2015/0365761 | A1* | 12/2015 | Alderson | G10K 11/1784 381/71.6 |
| 2016/0163304 | A1* | 6/2016 | Lee | G10K 11/178 381/71.4 |

* cited by examiner

METHOD, SYSTEM FOR SELF-TUNING ACTIVE NOISE CANCELLATION AND HEADSET APPARATUS

BACKGROUND OF THE INVENTION

1. Field of the Invention

The present invention is related to a technology providing parameters optimization for a noise-cancellation headset, in particular to a method and a headset apparatus for self-tuning active noise cancellation through emulation of environmental noise and error calibration.

2. Description of Related Art

A conventional ANC (Active Noise Control) headset is incorporated for microphones to capture ambient noise and generate opposite phase waveform to suppress noise. The corresponding noise cancelling waveform is generated based on either analog circuit or digital signal process.

Active noise cancellation technology includes a feedforward control method and a feedback control method. The feedback control method has better noise suppression, but is highly sensitive to components variations. Compared to feedback control method, the feedforward control method has more tolerance on components variations with less noise suppression.

A hybrid type of noise cancellation including feedforward and feedback control methods has been developed in the conventional technology. The hybrid noise cancellation combines both advantages to further enhance noise cancellation performance. However, the configuration having four microphones increases system complexity and cost accordingly.

FIG. 1 shows a schematic diagram describing the ANC headset in the conventional technology. The diagram shows a headset cap 100 covering a human ear 10. The headset apparatus includes an internal microphone and an external microphone respectively disposed inside and outside of the headset cap 100. A speaker 103 is disposed inside the headset cap 100. The internal microphone 105 is used to receive an error signal. The external microphone 107 is used to receive a reference signal.

To perform active noise cancellation, the headset apparatus uses the external microphone 107 to receive a reference signal, and uses the internal microphone 105 to receive an error signal inside the headset cap 100. The error signal is fed back to a digital signal processor (DSP) 101, to optimize filter parameters for a digital filter, e.g. a digital FIR Filter, for suppressing the noise delivered to the human ear 10 to a minimum.

SUMMARY OF THE INVENTION

The disclosure discloses a method and a system for self-tuning active noise cancellation, and a headset apparatus. The system emulates environmental noise and acquires error calibration signals to optimize parameters with respect to the headset apparatus as a factory setting. The system allows the feedforward ANC headset apparatus to achieve hybrid ANC performance without additional cost of materials.

According to one of the embodiments, in the method for self-tuning ANC, use a speaker to emulate environmental noise for a headset apparatus. The system performs digital FIR filter to generate waveform to suppress the environmental noise. The residuals are received by an audio measurement unit. The residuals act as the error signal to adaptively optimize FIR parameters for the system.

In one embodiment, the system for self-tuning ANC uses an adaptive algorithm to continuously update FIR parameters till error signal is lower than preset threshold. The corresponding parameters are stored as the factory setting for the headset apparatus.

The system primarily includes an output/input unit to generate environmental noise to the headset apparatus and receives the error signal from an audio measurement unit. The system includes a (Digital Signal Processor) DSP unit to perform FIR filtering. The self-tuning ANC uses an adaptive arithmetic with error signal to optimized FIR parameters. The system includes a memory unit to store parameters after optimization.

In the system for self-tuning ANC, the artificial ear measurement system is used to collect error signal of the noise cancelling headset apparatus.

The system for self-tuning ANC determines the performance based on error signal level. The parameters for self-tuning ANC are continuously updated until the error signal is lower than preset threshold. In the meantime, the parameters for self-tuning ANC are stored as a default setting for the corresponding headset apparatus.

The headset apparatus includes a memory unit, a DSP, two microphones and two speaker units. The microphones are used to obtain external environmental noise. The DSP performs FIR filtering with optimized parameters from the memory unit, to generate reverse waveform to suppress environment noise.

DETAILED DESCRIPTION OF THE PREFERRED EMBODIMENTS

The present invention will now be described more fully with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is related to a technology of providing parameters optimization for a noise-cancellation headset. According to the embodiments in the disclosure, the method and the system for self-tuning ANC that is able to emulate ambient noise and conduct error calibration and a headset apparatus with parameters optimization for self-tuning ANC are provided. One of the objectives of the present invention is to render a default setting of the parameters for tuning noise for the headset apparatus when it is produced. By providing the noise-tuning optimized parameters, the mechanism allows an ANC headset apparatus to have advantages from both feedforward control and feedback control technologies for ANC without adding additional ANC microphones.

Figure 1:
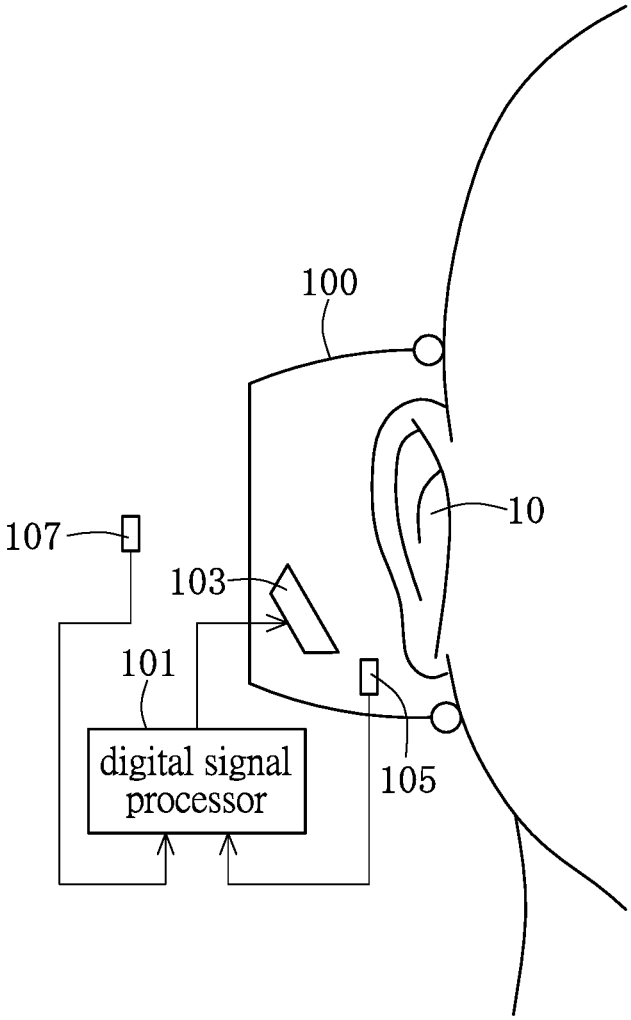
FIG. 1 PRIOR ART
FIG. 1 shows a schematic diagram describing an ANC headset of the conventional technology.
Figure 2A:
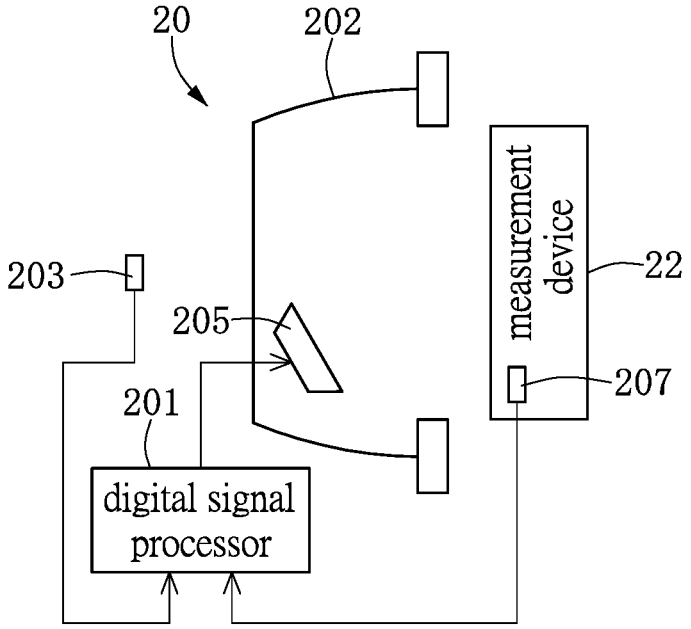
FIG. 2A shows a schematic diagram depicting a system framework for self-tuning ANC in one embodiment of the present invention.

One of the embodiments of the framework of the system for self-tuning ANC is referred to in a schematic diagram of the FIG. 2A. The main components of the headset apparatus 20 are such as a digital signal processor 201, a sound receiver 203 for receiving external noise and a speaker unit 205 disposed in a headset cap 202. Further, in the system, an audio signal receiver 207 is disposed in the measurement device 22.

When the system for self-tuning ANC is in operation, the headset apparatus 20 is mounted onto a measurement device 22. The measurement device 22 has an audio signal receiver 207 that is connected to a line-in interface of the headset apparatus 20. The digital signal processor 201 then receives the environmental noise from the sound receiver 203, and the environmental noise becomes a reference signal. An analog-to-digital conversion may be performed upon the reference signal for generating a noise signal. The digital signal processor 201 receives the error signal measured by the measurement device 22 from the audio signal receiver 207 via the line-in interface. It is noted that the error signal is provided for the system to assess the present performance of noise cancellation. The digital signal processor 201 processes an active noise control process by performing an adaptive algorithm. The adaptive algorithm is exemplarily a method of Normalized Least Mean Square that optimizes parameters for self-tuning ANC. The parameters for self-tuning ANC are applied to a filter equation. The reference signal is applied to the filter equation for generating a series of filtered reference signals and also rendering reverse noise signals. The speaker unit 205 in the headset apparatus 20 outputs the reverse noise signals for suppressing the continuously-received environmental noise. It is noted that the filter equation is exemplarily an LMS-based algorithm for rendering a Filter-X LMS algorithm.

Under this mechanism of self-tuning ANC in accordance with the present invention, the reverse noise signals outputted by the speaker unit 205 are used to suppress the continuously-received environmental noise. The residuals after noise cancellation are received by the audio signal receiver 207 in the measurement device 22. An error signal is formed. The error signal is compared with a threshold. The system judges if the error signal is lower than the threshold. If the judgment shows it is necessary to continue the process, the digital signal processor 201 again conducts the active noise control, and finds the optimized parameters for self-tuning ANC after computation until the error signal is lower than the threshold.

Figure 2B:
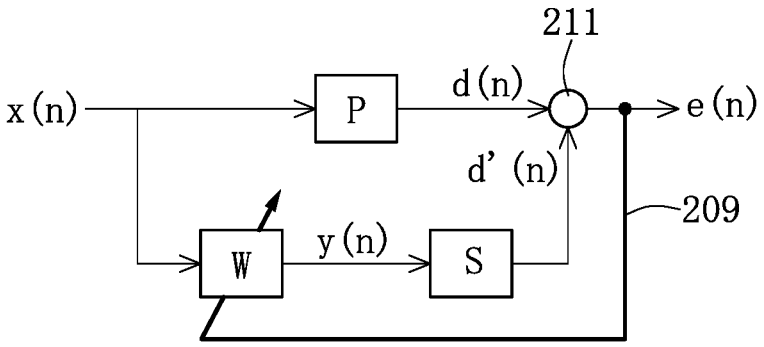
FIG. 2B shows an example of transfer function of the system for self-tuning ANC according to one embodiment of the present invention.

FIG. 2B schematically shows the implementation of transfer function in the system for self-tuning ANC in one embodiment of the present invention.

When the system is in operation, an environmental noise emulation unit emulates the environmental noise. The environmental noise acts as a reference signal x(n) for the system for self-tuning ANC. Over a main signaling path, e.g. a second path, the reference signal x(n) is transferred through a shell or ear cap of the headset apparatus. It is shown as an ear cap transfer function P indicative of the ear cap effect caused by the headset apparatus. The earcap transfer function P represents a spatial response when the reference signal x(n) is transferred to a noise signal d(n) over this first path. The noise signals d(n) are deemed to be the main target to be cancelled by the system.

There is another path, e.g. a second path, in the system for self-tuning ANC. Over this second path, the reference signal x(n) formed by the environmental noise is filtered by a self-tuning digital filter using filter parameters W. The signals over the second path undergo at least analog-to-digital conversion, signal reconstruction, and power adjustment. The self-tuning digital filter introduces a set of filter parameters W, e.g. the optimized parameters for a self-tuning ANC headset, and produces filtered signals y(n). The transfer function S is an equivalent transfer function over this second path, and is used to assess the pulse response over the second path. The pulse response assessed by the transfer function S covers the various electronic components over the second path. The electronic components are such as a microphone (not shown in this drawing), a pre-amplifier, pre-low-pass filter, analog-to-digital converter, and/or a speaker that the audio signals will pass through. Further, a digital-to-analog converter, and post-low-pass filter may be included over the path. The filtered signals y(n) form ANC signals d'(n) through the transfer function S over the second path. The filter signals form a kind of reverse noise signals.

An error computation 211 is applied in between the noise signals d(n) and the ANC signals d'(n) for obtaining a difference there-between. This difference indicates the error signal e(n). The error signal e(n) is such as an estimated value of the residual noise that is required to be suppressed. The reverse noise, e.g. the function d'(n), produced by an ANC mechanism, is provided for the system to cancel the noise signal, e.g. d(n). The residual noise acts as a basis for assessing the performance of noise cancellation, and as the feedback (209) for generating the optimized parameters for the self-tuning ANC headset. The parameters for self-tuning ANC of the headset form the reference for updating the filter parameter W.

When the system is in operation, the computation referring to the above transfer function can be repeated for obtaining the optimized parameters for self-tuning ANC for constantly updating the filter parameter W and obtaining the error signal e(n). When the error signal associated with the system reaches a specific condition requirement, the corresponding optimized parameters for self-tuning ANC are stored to be a default setting of the filter parameter W for the headset apparatus.

Figure 3:
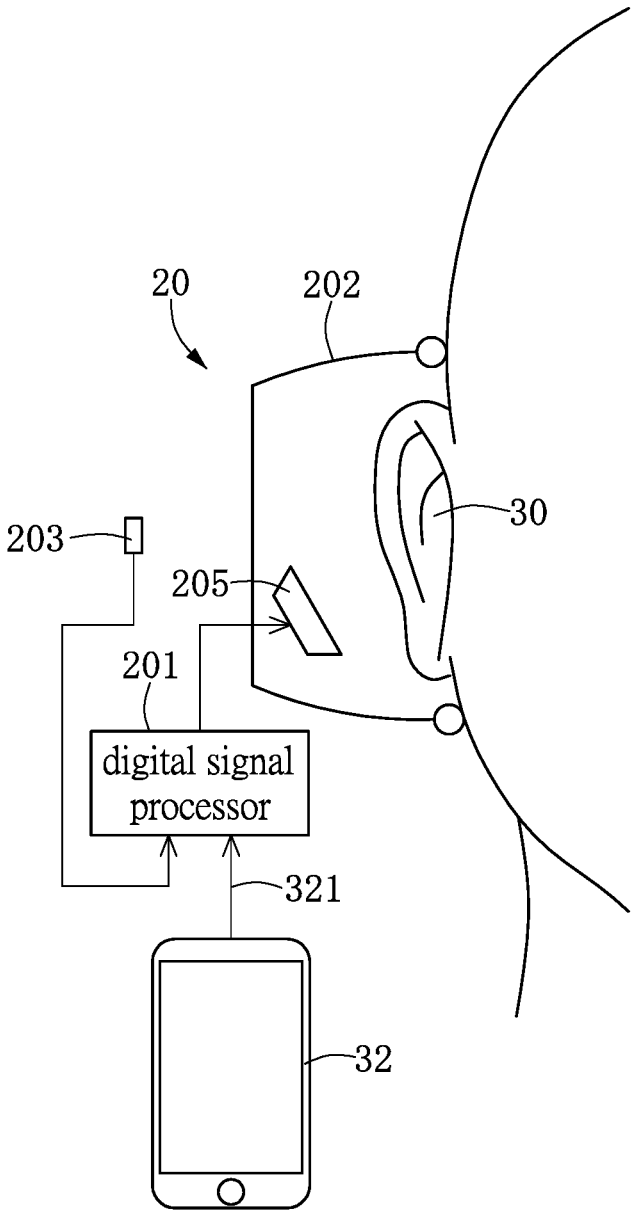
FIG. 3 shows a schematic diagram depicting a headset apparatus receiving parameters for noise-cancellation generated by the system for purpose of self-tuning ANC according to one embodiment of the present invention.

Reference is made to FIG. 3 showing a schematic diagram depicting a headset apparatus 20 incorporating noise-cancellation parameters optimized by the system for self-tuning ANC according to one embodiment of the present invention. The headset apparatus 20 is such as a device having the optimized parameters for self-tuning ANC provided by the system of the present invention. The headset apparatus 20 has its corresponding optimized parameters for self-tuning ANC stored in its memory as it was produced in the factory. The system for self-tuning ANC in the factory renders the optimized parameters associated with the corresponding mode, type, or brand of the headset apparatuses that adopt the same electronic components or materials. The drawing schematically shows the headset apparatus 20 put on a human ear 30, and a headset cap 202 covers the ear 30.

When the headset apparatus 20 is in operation, the headset apparatus 20 connects to an external sound source 32 via a signaling line 321 associated with a line-in interface. The line-in interface is such as an interface for receiving the audio signals. The audio signals produced by the external sound source 32 are inputted to the headset apparatus 20. The digital signal processor 201 introduces the parameters for self-tuning ANC of a headset for the specified headset apparatus by an optimized ANC process. The headset apparatus 20 receives environmental noise via a sound receiver 203. The digital signal processor 201 further incorporates the parameters from the memory unit into the ANC filter equation for generating the reverse noise signals against the environmental noise. A speaker unit 205 then outputs the reverse noise signals for suppressing the environmental noise. The audio signals after the suppressing process, including the audio signals from the external sound source, are inputted to the ear 30.

Referring to the system described in FIG. 2A and FIG. 2B, in a calibration mode, the system for self-tuning ANC is exemplarily implemented by an independent circuit system. This circuitry embodies an ANC system in the headset apparatus that employs the optimized parameters for self-tuning ANC.

Figure 4:
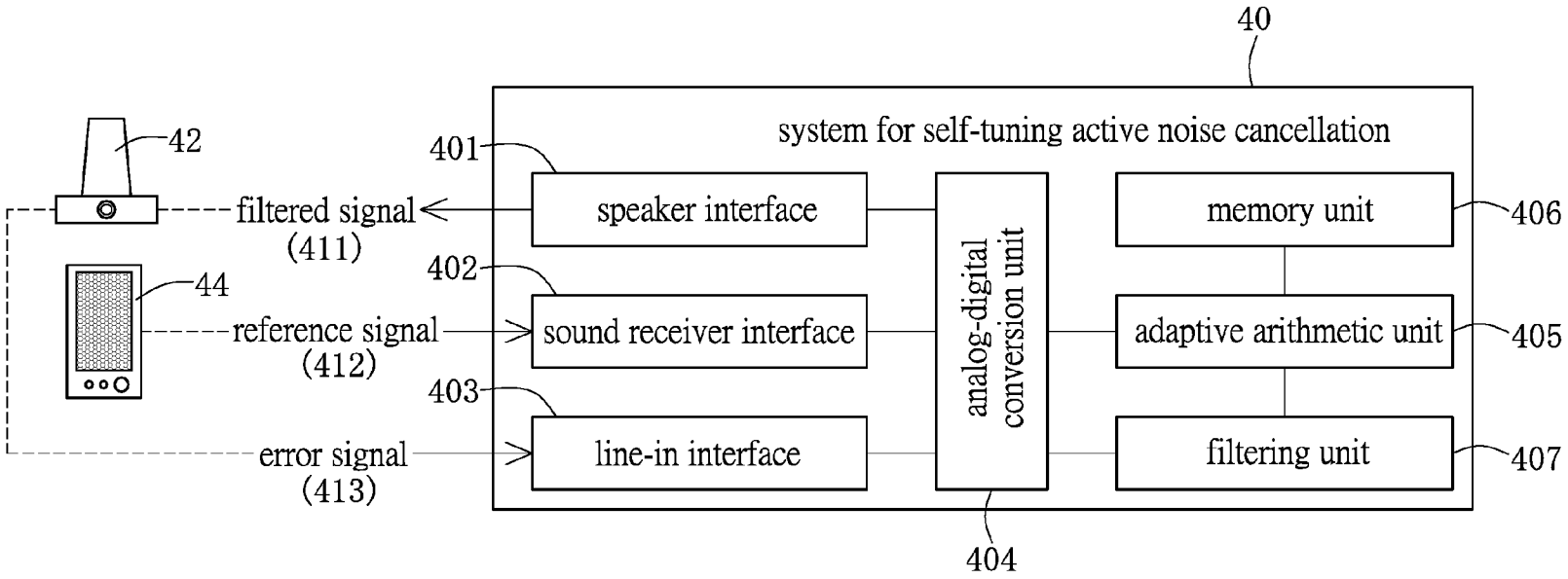
FIG. 4 shows a circuit block diagram depicting a circuitry of the system for self-tuning ANC in one embodiment of the present invention.

FIG. 4 schematically shows a circuit system for implementing a system for self-tuning ANC 40. The system 40 embodies the ANC system in a headset apparatus. Under a calibration mode, the circuitry inside the ANC headset apparatus implements the system for noise cancellation. The functions of the system can be implemented by the circuit units.

The system for self-tuning ANC 40 includes a sound receiver interface 402, e.g. a MIC port, for receiving external audio signals. The system 40 includes a speaker interface 401, e.g. a SPEAKER port, and a line-in interface 403, e.g. a Line-In port. The main circuits for processing the signals in the system include a filtering unit 407, an analog-digital conversion unit 404, an adaptive arithmetic unit 405, and a memory unit 406.

When the system for self-tuning ANC 40 is in operation, an environmental noise emulation unit 44 emulates environmental noise. In an exemplary example, the environmental noise is received by a microphone disposed in the headset apparatus under test. This microphone can be disposed on an audio measurement unit 42. The environmental noise is inputted to the system for self-tuning ANC 40 via the signaling line so as to form the reference signal 412 for the system 40. The reference signal 412 is inputted to the system via a sound receiver interface 402.

The reference signal 412 is converted to a digital signal by an analog-digital conversion unit 404. The digital signal is processed by a filtering unit 407 incorporating the optimized parameters for self-tuning ANC. The set of digital signals are processed by a filter equation, and converted back to analog signals by the analog-digital conversion unit 404. The produced signals form the reverse noise signals for suppressing the environmental noise. The filtered signals 411 are outputted to the headset apparatus via the speaker interface 401.

A default setting of parameters, or the optimized parameters generated by the previous process, is applied, and the filtered signals 411 are the result caused by the system processing ANC to the reference signal 412. The filtered signals 411 are then outputted to the headset apparatus. The filtered signals 411 are used to suppress the environmental noise that is generated by environmental noise emulation unit 44. The residuals from this cancellation are received by the audio measurement unit 42. An error signal 413 is therefore generated, and inputted to the system 40 via the line-in interface 403.

It is worth noting that the line-in interface 403 is an interface of the headset apparatus. Under this calibration mode, the error signal 413 is inputted to the system for self-tuning ANC 40 via the line-in interface 403. The error signal 413 is converted to a digital signal by the analog-digital conversion unit 404. The error signal is computed by an adaptive arithmetic unit 405 using an adaptive algorithm for adjusting coefficients for the active noise control filter equation. The optimized parameters for the self-tuning ANC headset are therefore produced.

In one embodiment, the optimized parameters for self-tuning ANC allow the system to minimize instantaneous squared error of the error signal. For example, a method of stochastic gradient or a Least Mean Square is used to tune the coefficients of the adaptive algorithm.

When the adaptive algorithm is provided to optimize the noise-cancellation performance of the system, a set of parameters for self-tuning ANC are applied to the filter equation allowing the headset apparatus to generate the next set of filtered signals 411 by applying the reference signals to the filter equation. The next filtered signals 411 are then outputted via the speaker interface 401.

The updated parameters for self-tuning ANC are used to form the next filtered signals outputted by the headset apparatus, and the environmental noise is suppressed. The audio measurement unit 42 again receives internal audio signals for producing the error signal 413. The system for self-tuning ANC 40 can accordingly assess this error signal 413. If the error signal 413 is in compliance with requirement of the system, the corresponding parameters for self-tuning ANC are stored in the memory unit 406.

In one embodiment of the present invention, the system 40 assesses the performance of noise cancellation every time it receives the error signal 413. For example, a threshold is introduced to process the assessment. If it is determined that the error signal 413 is not the best value or has not yet reached the requirement, the above process will be repeated and continuously update the parameters for self-tuning ANC until the error signal 413 reaches the requirement. The corresponding parameters for self-tuning ANC are stored and adapted to the corresponding model, type or brand of headset apparatus.

The audio measurement unit 42 embodies a measurement device for implementing an artificial ear measurement system, e.g. ITU-P57 type 2, that is used to emulate the human ear. A hole at one end of the audio measurement unit 42 is used to dispose the speaker components of the headset apparatus under test. The audio measurement unit 42 receives internal signals and the received analog signals act as the error signal.

Figure 5:
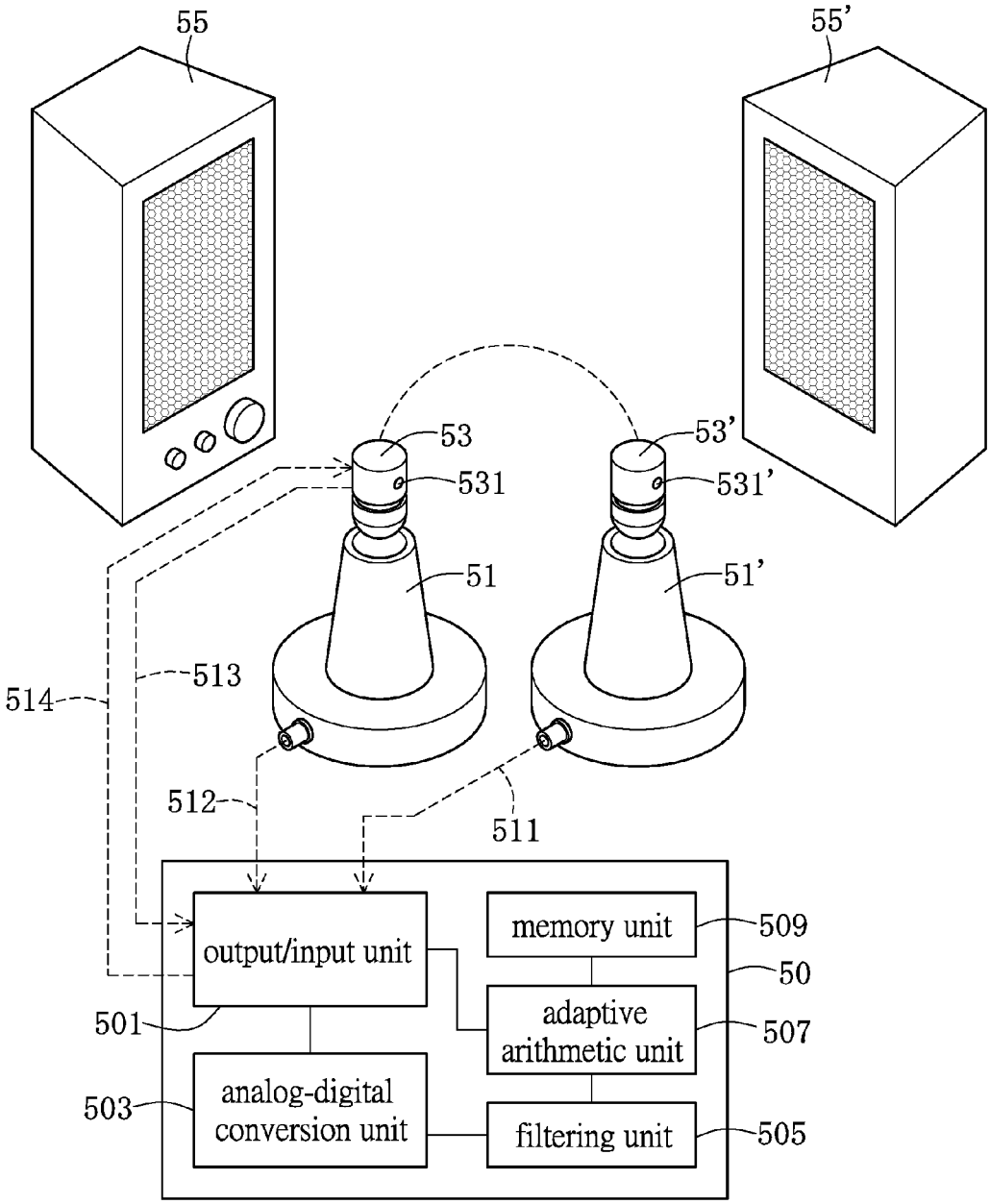
FIG. 5 shows a diagram showing a whole set-up of the system for self-tuning ANC in one embodiment of the present invention.

In FIG. 5, a schematic diagram depicting the system for self-tuning ANC in accordance with the present invention is disclosed. The system for self-tuning ANC 50 embodies a circuit system of the headset apparatus with the function of ANC. The circuit units can be implemented by integrated circuit, electronic circuits or firmware.

The diagram shows a circumstance of setting up the system for self-tuning ANC 50 according to one embodiment of the present invention. Speaker set shown in the diagram is continuously broadcasting the emulated environment noise. The speakers embody a pair of environment noise emulation units 55, 55' of the system. The headset apparatus has a couple of earplugs 53 and 53' that are placed on a measurement device (51, 51'). The earplugs 53, 53' of the headset apparatus 53, 53' are equipped with sound receivers 531 and 531' that are used to receive external audio signals, e.g. the environmental noise. The measurement device implements the audio measurement units 51 and 51' of the system that is used to act as the artificial ear measurement system for emulating the human ear. The internal speakers (53, 53') of the headset apparatus 53, 53' are placed toward the holes of the audio measurement units 51, 51'. The diagram shows the internal speakers (53, 53') placed downwards towards the audio measurement units 51, 51'. The arrangement allows the audio measurement unit 51, 51' to receive the audio signals, including the environmental noise and signals for suppressing the noise, outputted by the headset apparatus 53, 53'. The audio measurement unit 51, 51' outputs error signals over lines 511, 512 to the system for self-tuning ANC 50.

According to this arrangement, the output/input unit 501 of the system for self-tuning ANC 50 can be various interfaces of the headset apparatus. The interfaces of the headset apparatus are such as the speaker interface (401, FIG. 4), the sound receiver interface (402, FIG. 4) for receiving external noise signal, and the line-in interface (403, FIG. 4) for receiving audio signals of the external sound source. The output/input unit 501 is allowed to receive environmental noise signals from outside of the headset apparatus 53, 53'. The environmental noise signals form a reference signal 513 in the system for self-tuning ANC 50. The output/input unit 501 outputs the filtered signals 514 from the system 50 and the filtered signals 514 adequately act as the reverse noise signals used for suppressing part or all of the environmental noise. The output/input unit 501 also receives the error signal produced by the audio measurement units 51, 51' via the line-in interface. In a user mode rather than the calibration mode, this line-in interface is such as the audio interface of the headset apparatus.

The system for self-tuning ANC 50 includes an analog-digital conversion unit 503 for processing analog to digital signals conversion. For example, the analog-digital conversion unit 503 converts the analog audio to digital signals or converts the digital signals to the analog audio.

An adaptive arithmetic unit 507 in the system 50 is used to perform an adaptive algorithm. The adaptive algorithm is such as a method of Normalized LMS that is used to compute a coefficient for the filter equation for receiving the error signal. The optimized parameters for self-tuning ANC are subsequently determined.

A filtering unit 505 of the system 50 introduces the optimized parameters for self-tuning ANC being applied to the filter equation. The reference signal is applied to the filter equation for producing the filtered signals that are used to generate reverse noise signals to suppress the environmental noise.

The system 50 has a memory unit 509. In the calibration mode, the system 50 records the self-tuned parameters for self-tuning ANC to its memory unit 509. In the user mode, the memory unit 509 of the headset apparatus (53, 53') is used to store the optimized parameters for the headset apparatus (53, 53') for ANC.

When the system is in operation, the headset apparatus 53, 53' continuously receives the noise signals emulated by the environmental noise emulation units 55, 55'. Via the output/input unit 501, the system 50 incorporates the environmental noise to be the reference signal 513. In the system 50, the reference signal 513 is processed by analog-to-digital conversion. The filtering unit 505 conducts filtering using the optimized parameters for self-tuning ANC, so as to form the filtered signals 514. The filtered signals 514 are outputted to the headset apparatus (53, 53'). The speaker units inside the headset apparatus (53, 53') broadcast the filtered signals 514. The headset apparatus utilizes the filtered signals to suppress the environmental noise signals. The residuals received by the audio measurement units (51, 51') act as the error signal (511, 512) used to assess the performance of noise cancellation.

Thus, the system 50 can employ a threshold to assess the error signal (511, 512). If the error signal does not meet the requirement made by the system, the adaptive arithmetic unit 507 again is used to generate parameters for self-tuning ANC, and the filtered signals. Otherwise, if the error signal meets the requirement, the corresponding optimized parameters for self-tuning ANC are stored in the memory unit 509 of the headset apparatus. The stored parameters are to be the default setting or the factory value.

It is noted that the filtering unit 505 may be a kind of Finite Impulse Response (FIR) that is used to produce signals for ANC.

Figure 6:
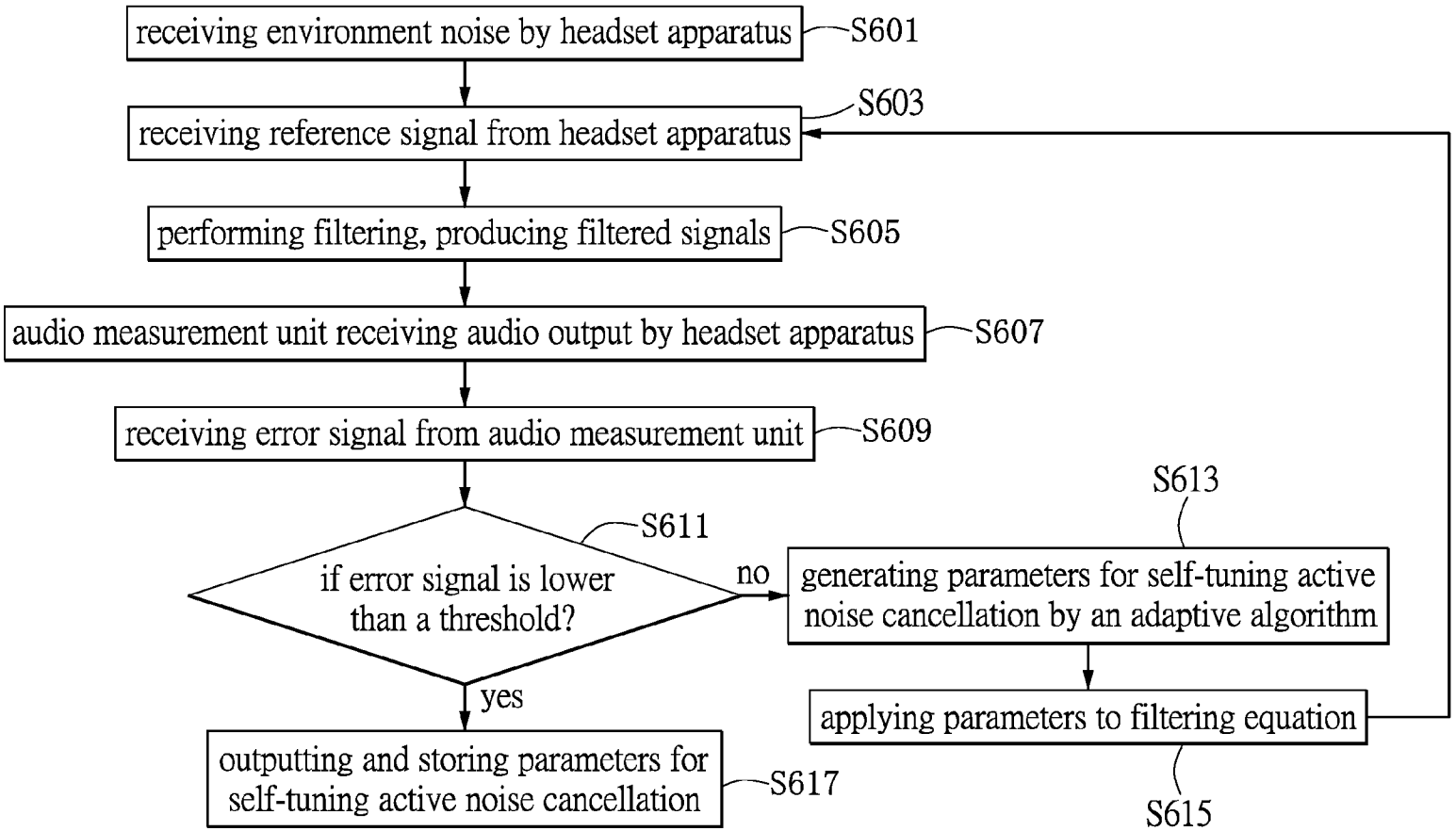
FIG. 6 shows a flow chart describing process in the method for self-tuning ANC in one embodiment of the present invention.

FIG. 6 shows a flow chart describing the method for self-tuning ANC according to one of the embodiments of the present invention.

The arrangement of the headset apparatus implements an audio measurement unit for receiving the audio signals of the headset apparatus. In step S601, a sound receiver of the headset apparatus is used to receive external environmental noise signals from a noise source. The environmental noise signals can be emulated by the aforementioned environmental noise emulation unit in factory. The environmental noise forms the reference signal outputted to the system. The sound receiver is such as an external microphone disposed on a shell of the headset apparatus. The environmental noise emulation unit has a speaker to output the emulated environmental noise.

In step 603, the system obtains the environmental noise signals received by the headset apparatus via the signaling line. The environmental noise forms the reference signals for the system. Next, in step S605, the system performs an ANC filtering process by for example a FIR filter using the received reference signal. The ANC filtering process allows the system to produce the filtered signals. The system performs an ANC filtering process incorporating a set of parameters for self-tuning ANC, and the reference signal is adapted to generate filtered signals. It is noted that the parameters for self-tuning ANC are the initial values when the system performs a first ANC process.

The filtered signals are preferably a series of reverse noise signals. The filtered signals are outputted to the headset apparatus, as in step S607, and the headset apparatus outputs the filtered signals for suppressing the environmental noise. The residuals are outputted by the speaker unit of the headset apparatus, and received by an audio measurement unit, in step S609. The system receives the error signal generated by the audio measurement unit once it receives the filtered signals. The audio signals outputted by the headset apparatus are the signals under noise cancellation using the specific parameters for self-tuning ANC. The audio measurement unit receives the audio signals outputted by the headset apparatus, and the system can acquire the noise signals received by the human ear. The residuals after noise cancellation form the error signal generated by the audio measurement unit allowing the monitoring of the performance of noise cancellation of the system. The error signal acts as the reference for the system to calibrate the filtering parameters in the headset apparatus.

In step S611, a threshold is introduced to assess the quality, especially the filtering parameters provided for the headset apparatus, in which the system judges if the error signal is lower than the threshold.

If the error signal is higher than or equal to the threshold, as in step S613, the adaptive algorithm reproduces a set of parameters for self-tuning ANC for updating the previous parameters. In step S615, the updated parameters for self-tuning ANC are used to tune the filtering parameters in the ANC filtering process, and the process goes back to step S603 for repeating the steps S603 to S611, such as the step of ANC filtering process, outputting filtered signals, receiving error signal and assessing the error signal. The optimized parameters for self-tuning ANC are continuously produced and updated until the error signal is lower than the threshold. In step S617, the system stores the final parameters for self-tuning ANC that act as the filtering parameters for the headset apparatus.

The process described in FIG. 6 can be continuously in operation. The optimized parameters for self-tuning ANC are generated and updated in every process. The system continuously computes the reference signal generated from the received environmental noise to be measured until the error signal after noise cancellation is lower than a preset threshold. The parameters for self-tuning ANC stored in the headset apparatus act as the default setting/factory setting for the headset apparatus.

Thus, the above described embodiments of the method and the system for self-tuning ANC are particularly applied to generate the filtering parameters for the ANC headset apparatus adopting the hybrid framework of a conventional feedforward control method and a feedback control method. A measurement device is provided in the system for emulating the human ear to generate the filter parameters by an adaptive algorithm. The noise-cancellation parameters can be optimized by repeating the ANC filtering process. The optimized noise-cancellation parameters are stored in the headset apparatus for implementing the ANC just like the effect made by the conventional feedforward control method, or the hybrid framework. For example, through the method, the headset apparatus can use a two-microphone scheme to reach the effect made by the four-microphone ANC solution.

It is intended that the specification and depicted embodiment be considered exemplary only, with a true scope of the invention being determined by the broad meaning of the following claims.

What is claimed is:

1. A method for self-tuning ANC, comprising:

using a headset apparatus to receive environmental noise signals so as to form a reference signal;

performing an ANC filtering process, and the reference signal adapted to generate filtered signals; wherein the ANC filtering process incorporates a set of parameters for self-tuning ANC;

outputting the filtered signals to the headset apparatus, and the headset apparatus outputting the filtered signals for neutralizing the environmental noise signals, and forming residuals being received by an audio measurement unit;

receiving an error signal outputted by the audio measurement unit;

judging if the error signal is lower than a threshold;

performing an adaptive algorithm for updating the parameters for self-tuning ANC if the error signal is higher or equal to the threshold, so as to tune filter parameters in the ANC filtering process, and repeating the ANC filtering process, outputting the filtered signals, receiving the error signal, and judging the error signal until the error signal is lower than the threshold; and if the error signal is lower than the threshold, storing the corresponding parameters for self-tuning ANC.

2. The method as recited in claim 1, wherein the method is adapted to the headset apparatus, in which the parameters for self-tuning ANC are stored in a memory of the headset apparatus and become a factory setting for the headset apparatus.

3. The method as recited in claim 1, wherein the environmental noise signals are outputted by a speaker used to emulate the environmental noise, the environmental noise signals are received by a sound receiver of the headset apparatus so as to form a reference signal.

4. The method as recited in claim 3, wherein the method is adapted to the headset apparatus, in which the parameters for self-tuning ANC are stored in a memory of the headset apparatus and become a factory setting for the headset apparatus.

5. The method as recited in claim 1, wherein the adaptive algorithm uses a method of Normalized Least Mean Square.

6. The method as recited in claim 5, wherein the method is adapted to the headset apparatus, in which the parameters for self-tuning ANC are stored in a memory of the headset apparatus and become a factory setting for the headset apparatus.

7. A system for self-tuning ANC, comprising:

an output/input unit used to receive environmental noise signals obtained by a headset apparatus, and the environmental noise signals form a reference signal in the system; and output filtered signals generated by the system; and receive an error signal generated by an audio measurement unit;

a filtering unit employing a filter equation so as to conduct filtering using a set of parameters for self-tuning ANC and generating the filtered signals based on the reference signal;

an adaptive arithmetic unit computing the error signal so as to acquire coefficients for the filter equation, and deciding parameters for self-tuning ANC;

a memory unit used to store the parameters for self-tuning ANC that is applied to the headset apparatus to perform ANC;

wherein, the system for self-tuning ANC outputs the filtered signals to the headset apparatus via the output/input unit, and the headset apparatus utilizes the filtered signals to neutralize the environmental noise signals, and the residuals are received by the audio measurement unit; the system receives the error signal from the audio measurement unit;

the system judges if the error signal is lower than a threshold; if the error signal is higher than or equal to the threshold, an adaptive algorithm is performed to update the parameters for self-tuning ANC that is to tune filter parameters for an ANC filtering process, and steps of ANC filtering process, outputting the filtered signals, receiving the error signal, and assessing the error signal are repeated for updating the parameters for self-tuning ANC until the error signal is lower than the threshold; and if the error signal is lower than the threshold, the corresponding parameters for self-tuning ANC are stored.

8. The system as recited in claim 7, wherein the audio measurement unit implements an artificial ear measurement system used to emulate a human ear.

9. The system as recited in claim 7, wherein the output/input unit includes a sound receiver interface and the reference signal is inputted to the sound receiver interface via a signaling line.

10. The system as recited in claim 9, wherein the audio measurement unit implements an artificial ear measurement system used to emulate a human ear.

11. The system as recited in claim 7, wherein the output/input unit includes a line-in interface, and the system for self-tuning ANC receives the error signal via the line-in interface.

12. The system as recited in claim 11, wherein the audio measurement unit implements an artificial ear measurement system used to emulate a human ear.

13. A headset apparatus comprising a memory unit used to store the parameters for self-tuning ANC generated by the method as recited in claim 1.

14. The headset apparatus as recited in claim 13, further comprising a digital signal processor, a sound receiver and a speaker unit; wherein the sound receiver is used to acquire environmental noise, the digital signal processor used to generate reverse noise signals for neutralizing the environmental noise when the system applies the parameters for self-tuning ANC stored in the memory unit to an active noise control filter equation.

* * * * *